United States Patent [19]

Buchegger et al.

[11] Patent Number: 4,611,988

[45] Date of Patent: Sep. 16, 1986

[54] COILER-FURNACE UNIT

[75] Inventors: Rudolf Buchegger, St. Florian; Franz Hirschmanner, Leonding, both of Austria

[73] Assignee: Voest-Alpine Aktiengesellschaft, Linz, Austria

[21] Appl. No.: 739,437

[22] Filed: May 30, 1985

[30] Foreign Application Priority Data

Jun. 18, 1984 [AT] Austria ..... 1971/84

[51] Int. Cl.[4] ..... C21D 9/00; F24J 3/00

[52] U.S. Cl. ..... 432/183; 432/225

[58] Field of Search ..... 432/183, 184, 224, 225, 432/226; 266/123

[56] References Cited

U.S. PATENT DOCUMENTS 4,352,659 10/1982 Salmela et al. ..... 432/225

FOREIGN PATENT DOCUMENTS 373290 1/1984 Austria .

*Primary Examiner*—John J. Camby

*Attorney, Agent, or Firm*—Kurt Kelman

[57] ABSTRACT

For a heating of a coil of strip with hot gas without an increased formation of scale, a coiler-furnace unit comprising a heat-insulating housing, a coiler mandrel disposed in said housing, and a heating tube which is adapted to surround the coiler mandrel and to heat the latter, is characterized in that the heating tube consists of a radiant inner tube, which is enclosed by a shell, at least one hot gas passage is defined between the inner tube and the shell, the heat-insulating housing is double-walled to define at least one flow passage, and the outlet opening of the hot gas passage of the heating tube communicates with an inlet opening of the flow passage of the heat-insulating housing in at least one axial position of the heating tube.

5 Claims, 2 Drawing Figures

COILER-FURNACE UNIT

BACKGROUND OF THE INVENTION

1. Field of the Invention

This invention relates to a coiler-furnace unit comprising a coiler mandrel which is disposed within a heat-insulating housing and adapted to be heated by means of a heating tube that is adapted to be axially moved to a position in which the heating tube surrounding the coiler mandrel.

2. Description of the Prior Art

To avoid formation of scale of the strip coiled on the coiler mandrel by the heat of the hot gases supplied to the coiler-furnace unit, it is known from Austrian Pat. No. 373,290 to heat up the coiler mandrel by means of a heating tube, which is provided with electric heating means and can be axially pushed over the coiler mandrel. The coiler mandrel is heated by means of the heating tube and then serves to heat the strip, which is wound on the coiler mandrel when the heating tube has been pulled from the mandrel. As result, the coil formed by the strip is heated by heat conducted from the inside. Whereas it is simple to heat the coiler mandrel by an induction winding provided in the heating tube, that operation requires a suitable source of electric power. Besides, the coil-receiving chamber which is confined in the unit by the heat-insulating housing is not heated so that heat is dissipated by radiation and convection from the coil of strip which is to be heated.

SUMMARY OF THE INVENTION

It is a object of the invention to provide a coiler-furnace unit in which the coil of strip on the coiler mandrel can be heated with hot gas without formation of scale as a result of the temperature rise and without an increased radiation of heat from the coil of strip.

In a coiler-furnace unit of the kind described first hereinabove that object is accomplished in accordance with the invention with a heating tube consisting of a radiant inner tube enclosed by a shell, at least one hot gas passage being defined between the inner tube and the shell. The heat-insulating housing is double-walled to define at least one flow passage, and an outlet opening of the hot gas passage of the heating tube communicates with an inlet opening of the flow passage of the heat-insulating housing in at least one axial position of the heating tube.

Because the hot gas is used to heat the radiant tube and the coiler mandrel is heated by the radiant heat emitted by the radiant tube, the same advantages as are afforded by an electrically heated heating tube are obtaind in the heating of the coil of strip. But different from the use of electric heating means it is now possible to use the hot gases to preheat the coil-receiving chamber which is enclosed by the heat-insulating housing so that a radiation of heat from the coil of strip is substantially prevented and the sensible waste heat content of the hot gases can be utilized in an improved manner. When the radiant tube has been heated up, the hot gases may be sucked through the double-walled heat-insulating housing so that the coil-receiving chamber is heated by the inside surface of the heat-insulating housing. As a result, the temperature difference between the heated coil of strip and the coil-receiving chamber is greatly reduced so that the radiation of heat from the coil of strip is reduced correspondingly. Because the inlet opening of the flow passage of the heat-insulating. housing communicates directly with the outlet opening of the hot gas passage of the heating tube in at least one axial position of the heating tube, there is no need for special means connecting the two openings if care is taken that the heating tube is in the proper axial position as it is heated by the hot gases. In connection with the invention, it is not important whether the hot gas passage of the heating tube serves as a combustion chamber for producing the hot gases or whether hot flue gases are supplied to that hot gas passage.

DETAILED DESCRIPTION OF THE PREFERRED EMBODIMENT

Figure 1:
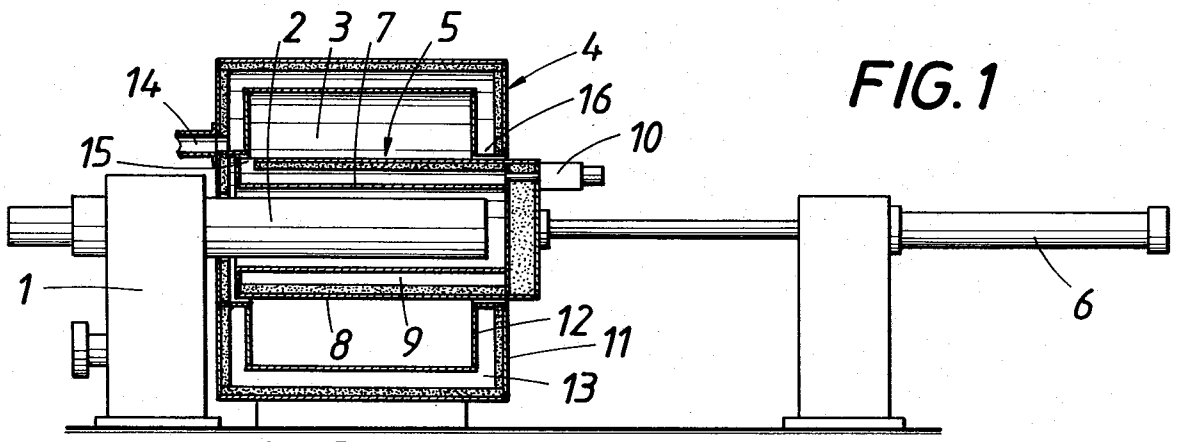
FIG. 1 is a diagrammatic sectional view showing a coiler-furnace unit embodying the invention and comprising a heating tube which surrounds a coiler mandrel.

An illustrative embodiment of the invention will now be described more in detail with reference to the drawing.

The coiler-furnace unit shown in the drawing comprises a coiler 1 having a coiler mandrel 2, which protrudes into a heat-insulating housing 4 defining a coil-receiving chamber 3 with the mandrel 2. The coiler mandrel 2 is heated by means of a heating tube 5, which is coaxial with the expanding mandrel 2 and is adapted to be axially pushed by a positioning cylinder 6 through a suitable opening of the heat-insulating housing to a mandrel-heating position, in which the tube 5 surrounds the mandrel 2. The arrangement is such that the free end of the heating tube 5 in its retracted position shown in FIG. 2 is still disposed in the heat-insulating housing 4 so that the heating tube 5 then closes the opening through which the tube 5 can be inserted into the housing 4.

The heating tube 5 consists of a radiant inner tube 7 and a heat-insulating shell 8. Between the radiant tube 7 and the shell 8, an annular space is defined, which constitutes a hot gas passage 9 for conducting hot gases for heating the radiant tube 7. A burner 10 may be used to produce such a stream of hot gas.

The heat-insulating housing 4 used within the scope of the invention differs from the conventional heat-insulating housings in that it is double-walled to define a flow passage 13 between a heat-insulating outer wall 11 of the housing 4 and its inner wall 12, which has a heat-delivering inside surface. Hot gases from the heating tube 5 can be conducted through the flow passage 13 to a gas outlet 14. For this purpose, the outlet opening 15 of the hot gas passage 9 of the heating tube 5 communicates directly with an inlet opening 16 of the flow passage 13 of the heat-insulating housing 4 when the heating tube 5 is in the position shown in FIG. 2. As a result, the hot gases flow through the outlet opening 15 and the inlet opening 16 into the flow passage 13 so that they transfer heat through the inner wall 12 of the heat-insulating housing 4 to the coil-receiving chamber 3. When the radiant tube 7 has been sufficiently heated, the positioning cylinder 6 is operated to push the heating tube 5 from its initial position shown in FIG. 2 to its mandrel-heating position, which is shown in FIG. 1 and in which the heating tube 3 surrounds the coiler mandrel 12 and the latter is heated by radiant heat from the radiant tube 7. If the coiler is to be preheated to a temperature of 900° to 1000° C., the radiant tube is to be heated, e.g., to a temperature of 1200° to 1280° C. In the embodiment shown by way of example, the heating of the radiant tube 7 is not continued during the heating of the coiler mandrel. In a different embodiment, the coiler mandrel 2 might be heated at the same time as the radiant tube 7 when the heating tube 3 is in the position shown in FIG. 1. In that case, the direction of flow in the flow passage 13 must be opposite to that in the embodiment shown end the inlet opening 16 must be disposed near the other end of the heat-insulating housing 4. But in such arrangement, the radiant tube 7 could not be heated while strip is being wound on and unwound from the coiler. If in such an alternative embodiment the heating tube should be heated also during the winding and unwinding operations, the heat-insulating housing 4 must contain at least one additional flow passage so that the hot exhaust gases from the heating tube can flow through one flow passage of the heat-insulating housing when the heating tube has been retracted and through the other flow passage of the heat-insulating housing when the heating tube has been advanced.

Figure 2:
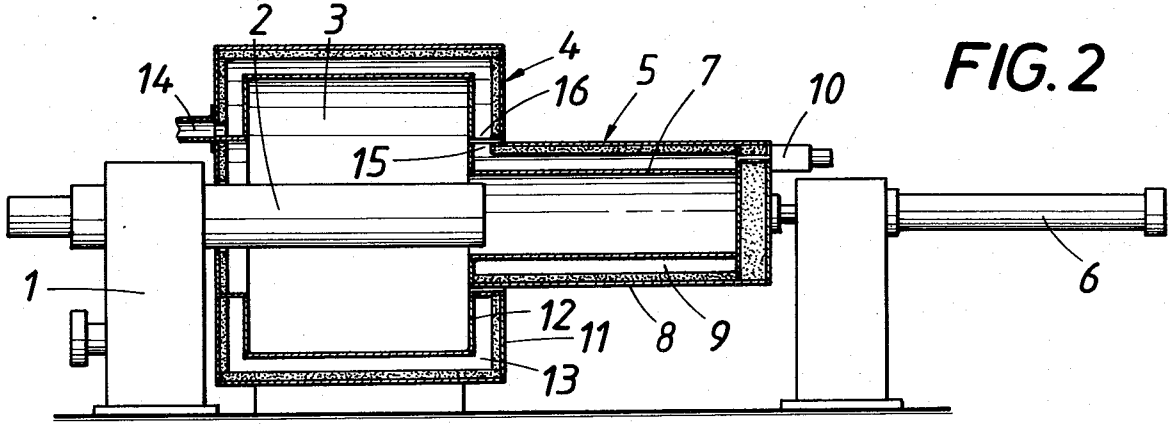
FIG. 2 is a similar view showing the same coiler-furnace unit when the heating tube has been pulled from the coiler mandrel.

When the coiler mandrel 2 has been preheated to the desired temperature, the heating tube 5 is retracted to its initial position shown in FIG. 2 and the coil to be heated is wound on the coiler mandrel 2 so that the latter delivers heat to the coil of strip.

We claim:

1. In a coiler-furnace unit comprising a heat-insulating housing, a coiler mandrel extending in said housing, and a heating tube which is axially movable to and from a heating position in which said heating tube surrounds and is adapted to heat said mandrel, the improvement wherein said heating tube comprises a radiant inner tube arranged to surround said mandrel in said heating position and a shell tube surrounding said radiant tube and defining with said radiant tube at least one hot gas passage having an outlet opening, and said housing consists of outer and inner walls defining between them at least one flow passage having a inlet opening arranged to communicate directly with said outlet opening in a predetermined axial position of said heating tube.

2. The improvement set forth in claim 1, wherein said flow passage extends substantially throughout the length of said housing.

3. The improvement set forth in claim 1, in which said heating tube is axially movable from said heating position to a protruding position, in which said heating tube protrudes from said housing and only one end of said heating tube is disposed adjacent to said housing, wherein said outlet opening is disposed at said one end of said heating tube and said inlet opening is arranged to communicate directly with said outlet opening when said heating tube is in said protruding position.

4. The improvement set forth in claim 1, wherein said inner wall defines a coil-receiving chamber with said mandrel and is adapted to transfer heat from said at least one flow passage to said coil-receiving chamber.

5. The improvement set forth in claim 1, wherein said shell comprises heat-insulating material.

* * * * *